US010745849B2

(12) United States Patent
Bensel et al.

(10) Patent No.: US 10,745,849 B2
(45) Date of Patent: Aug. 18, 2020

(54) NOZZLE ASSEMBLY FOR A WASHING MACHINE APPLIANCE

(71) Applicant: Haier US Appliance Solutions, Inc., Wilmington, DE (US)

(72) Inventors: Peter Hans Bensel, Louisville, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 172 days.

(21) Appl. No.: 15/886,899

(22) Filed: Feb. 2, 2018

(65) Prior Publication Data

US 2019/0242052 A1 Aug. 8, 2019

(51) Int. Cl.
*D06F 39/08* (2006.01)
*D06F 29/00* (2006.01)

(52) U.S. Cl.
CPC ..... *D06F 39/088* (2013.01); *D06F 29/00* (2013.01)

(58) Field of Classification Search
None
See application file for complete search history.

(56) References Cited

U.S. PATENT DOCUMENTS 6,691,536 B2 2/2004 Severns et al.
7,735,345 B2 6/2010 Wright et al.
7,814,768 B2 10/2010 Vecchi et al.
9,290,878 B2 * 3/2016 Lee ..... D06F 33/02
2002/0134117 A1 * 9/2002 Arai ..... D06F 19/00 68/3 SS
2005/0072194 A1 * 4/2005 Ryohke ..... D06F 19/00 68/3 R
2007/0067920 A1 * 3/2007 Zaccone ..... D06F 25/00 8/158
2007/0151311 A1 7/2007 McAllister et al.
2016/0040345 A1 * 2/2016 Kim ..... D06F 35/002 8/137
2016/0102425 A1 * 4/2016 Scheckelhoff ..... D06F 29/00 68/13 R
2016/0138207 A1 5/2016 Del Pos et al.
2016/0326685 A1 * 11/2016 Pollett ..... D06F 39/088

FOREIGN PATENT DOCUMENTS

CA 2760131 A1 6/2012
WO WO-9929953 A1 * 6/1999 ..... D06F 39/088

* cited by examiner

*Primary Examiner* — Cristi J Tate-Sims
(74) *Attorney, Agent, or Firm* — Dority & Manning, P.A.

(57) ABSTRACT

A washing machine appliance and nozzle assembly therefor are provided herein. The nozzle assembly may include an extendable nozzle, a valve assembly, and a retractable fluid supply. The extendable nozzle may be movable between a retracted position and an extended position. The extendable nozzle may define a fluid path in fluid communication between a nozzle inlet and a nozzle outlet. The extendable nozzle may further define an additive cavity in fluid communication with the fluid path downstream from the nozzle inlet and an additive opening in selective fluid communication with the additive cavity in parallel to the nozzle inlet. The valve assembly may be configured to provide a flow of wash fluid to the extendable nozzle. The retractable fluid supply conduit may extend in fluid communication between the valve assembly and the nozzle inlet of the extendable nozzle to direct the flow of wash fluid to the extendable nozzle.

20 Claims, 12 Drawing Sheets

NOZZLE ASSEMBLY FOR A WASHING MACHINE APPLIANCE

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash or rinse articles within the wash chamber. More specifically, a predetermined volume of wash fluid is typically provided through a stationary nozzle positioned at the center of the back wall of the washing machine appliance. However, in certain situations, a user may wish to have greater control over the wash fluid dispensed into the tub. For instance, a user may wish to add more or less of certain additives (e.g., detergent, bleach, fabric softener, etc.) depending on the particular articles within the tub. Moreover, a user may wish to direct the flow of wash fluid onto a particular garment or within a specific region of the wash tub (e.g., to perform a pretreating operation, to saturate a particular article of clothing). However, this ability may be limited by the increased complexity and wiring required to relocate existing stationary nozzles. The ability to adjust the amount of water or wash fluid and its dispensing location is a commercially desirable feature and increases the user's positive perception of the wash process generally.

Accordingly, a washing machine appliance that provides a user with more control over the dispensing of wash fluid is desirable. In particular, a nozzle assembly that enables the dispensing of an additional amount of wash fluid at a desired location within the tub would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub positioned within the cabinet, a wash basket, and a nozzle assembly. The wash basket may be rotatably mounted within the tub and define a wash chamber for receiving articles for washing. The nozzle assembly may be mounted within the cabinet and configured to provide wash fluid to the tub. The nozzle assembly may include an extendable nozzle, a valve assembly, and a retractable fluid supply. The extendable nozzle may be movable between a retracted position and an extended position. The extendable nozzle may define a fluid path extending in fluid communication between a nozzle inlet and a nozzle outlet. The extendable nozzle may further define an additive cavity in fluid communication with the fluid path downstream from the nozzle inlet and an additive opening in selective fluid communication with the additive cavity in parallel to the nozzle inlet. The valve assembly may be configured to provide a flow of wash fluid to the extendable nozzle. The retractable fluid supply conduit may extend in fluid communication between the valve assembly and the nozzle inlet of the extendable nozzle to direct the flow of wash fluid to the extendable nozzle.

In another exemplary aspect of the present disclosure, a nozzle assembly for a washing machine appliance is provided. The nozzle assembly may include an extendable nozzle, a valve assembly, and a retractable fluid supply. The extendable nozzle may be movable between a retracted position and an extended position. The extendable nozzle may define a fluid path extending in fluid communication between a nozzle inlet and a nozzle outlet. The extendable nozzle may further define an additive cavity in fluid communication with the fluid path downstream from the nozzle inlet and an additive opening in selective fluid communication with the additive cavity in parallel to the nozzle inlet. The valve assembly may be configured to provide a flow of wash fluid to the extendable nozzle. The retractable fluid supply conduit may extend in fluid communication between the valve assembly and the nozzle inlet of the extendable nozzle to direct the flow of wash fluid to the extendable nozzle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
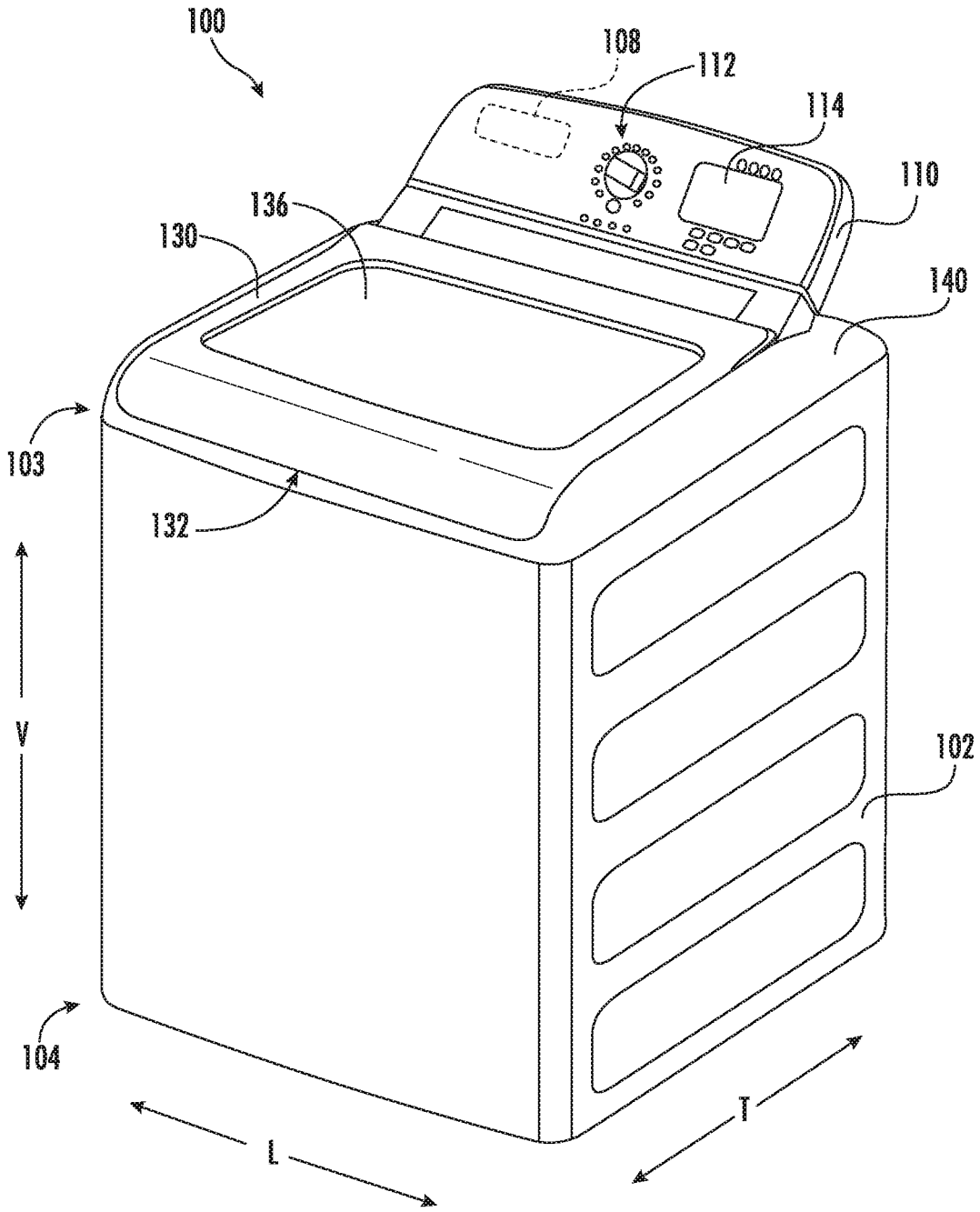
FIG. 1 provides a perspective view of a washing machine appliance according to an exemplary embodiment of the present disclosure with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
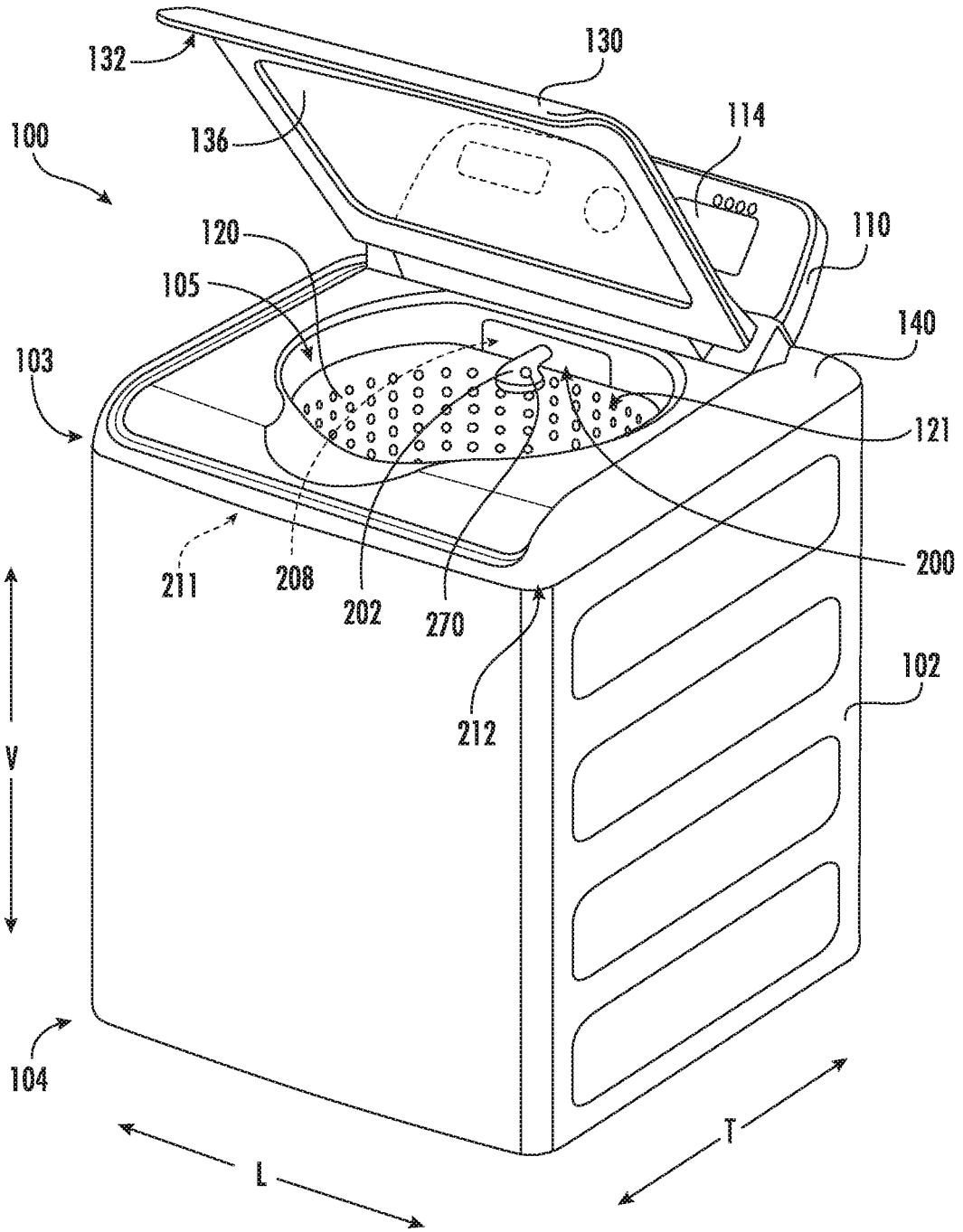
FIG. 2 provides a perspective view of the exemplary washing machine appliance of FIG. 1 with the door of the exemplary washing machine appliance shown in an open position.

Turning now to the figures, FIGS. 1 and 2 illustrate an exemplary washing machine appliance 100. In particular appliance 100 is shown as a vertical axis washing machine. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that washing machine appliance 100 is provided by way of example only. Other washing machine appliances having different configurations, different appearances, or different features may also be utilized with the present subject matter as well (e.g., horizontal axis washing machines). Moreover, aspects of the present subject matter may be used in any other consumer or commercial appliance where it is desirable to control the dispensing of water or another fluid.

As shown, washing machine appliance 100 has a cabinet 102 that extends between a top portion 103 and a bottom portion 104 along the vertical direction V. A wash basket 120 is rotatably mounted within cabinet 102. A motor (not shown) is in mechanical communication with wash basket 120 to selectively rotate wash basket 120 (e.g., during an agitation cycle or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. An agitator or impeller (not shown) may extend into wash basket 120 while remaining in mechanical communication with the motor. The impeller generally assists agitation of articles disposed within wash basket 120 and may rotate or oscillate during operation of washing machine appliance 100.

Cabinet 102 of washing machine appliance 100 generally includes a top panel 140. Top panel 140 defines an opening 105 (FIG. 2) that permits user access to wash basket 120 of wash tub 121. In some embodiments, door 130 is rotatably mounted to top panel 140 and permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In some embodiments, a window 136 in door 130 permits viewing of wash basket 120 when door 130 is in the closed position (e.g., during operation of washing machine appliance 100). Door 130 may also include a handle 132 that, for example, a user may pull or lift when opening and closing door 130. Further, although door 130 is illustrated as mounted to top panel 140, alternatively, door 130 may be mounted to another portion of cabinet 102, as well as any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation.

Operation of washing machine appliance 100 is generally controlled by a controller or processing device 108 that is attached to cabinet 102 (e.g., at control panel 110) and operatively coupled (e.g., electrically coupled via one or more conductive signal lines, wirelessly coupled via one or more wireless communications bands, etc.) to portions of control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are generally loaded into wash basket 120 through opening 105, and a washing operation is initiated through operator manipulation of input selectors 112. Wash basket 120 is filled with a fluid, such as water and detergent or other fluid additives (e.g., via a nozzle assembly 200—described in detail below). One or more valves can be controlled by washing machine appliance 100 to provide for filling wash basket 120 to the appropriate level for the amount of articles being washed or rinsed. By way of example, for a washing cycle, once wash basket 120 is properly filled with fluid, the contents of wash basket 120 can be agitated (e.g., with an impeller as discussed above) for washing laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After laundry items or articles disposed in wash basket 120 are cleaned or washed, the user can remove the articles from wash basket 120 (e.g., by reaching into wash basket 120 through opening 105).

Referring now generally to FIGS. 2 through 7, nozzle assembly 200 will be described in more detail according to various exemplary embodiments of the present disclosure. Although the discussion below refers to nozzle assembly 200, one skilled in the art will appreciate that the features and configurations described may be used for other fluid supply assemblies in other washing machine appliances as well. For example, nozzle assembly 200 may be positioned in another location within cabinet 102, may have a different fluid supply conduit configuration, or may dispense any suitable wash fluid or fluids (e.g., water, detergent, other additives, or mixtures thereof). Other variations and modifications of the exemplary embodiments described below are possible, and such variations are contemplated as within the scope of the present disclosure.

As illustrated, nozzle assembly 200 generally includes an extendable nozzle 202 mounted to a retractable fluid supply conduit 204. More specifically, retractable fluid supply conduit 204 provides fluid communication between extendable nozzle 202 and a valve assembly 206. In addition, valve assembly 206 is coupled to a supply of water or wash fluid and selectively provides a flow of wash fluid to extendable nozzle 202 so that a user may selectively dispense the wash fluid within wash tub 121. For example, according to the illustrated exemplary embodiments of FIGS. 3 and 4, valve assembly 206 (and thus extendable nozzle 202) is directly coupled to a primary hot and cold water supply 207. In some such embodiments, retractable fluid supply conduit 204 is movable for positioning extendable nozzle 202 in a retracted position and an extended position, as described in more detail below. In this manner, extendable nozzle 202 may function as a primary fill nozzle in the retracted position and a spot treatment wand in the extended position.

Nozzle assembly 200 and its various components may be stored or mounted within cabinet 102 of washing machine appliance 100. In some embodiments, nozzle assembly 200 is mounted directly under top panel 140 along the vertical direction V such that nozzle assembly 200 is positioned between wash tub 121 and top panel 140. In this regard, washing machine appliance 100 may include a nozzle housing 208 defining a receiving chamber 209 within which fluid supply conduit 204 or extendable nozzle 202 are at least partially positioned. For example, when extendable nozzle 202 is in the retracted position, extendable nozzle 202 may be positioned within receiving chamber 209. In some such embodiments, extendable nozzle 202 remains visible to the user in the retracted position. However, when extendable nozzle 202 is pulled out toward the extended position, extendable nozzle 202 and at least a portion of fluid supply conduit 204 are positioned outside the receiving chamber 209 of nozzle housing 208 (e.g., above wash tub 121 along the vertical direction V). Notably, maintaining the position of extendable nozzle 202 above the wash tub 121 ensures that wash fluid from within the wash tub 121 cannot be drawn back through extendable nozzle 202 (e.g., into the water supply or leaked elsewhere within washing machine appliance 100).

Although the positioning and movement of nozzle assembly 200 is described herein according to exemplary embodiments, it should be appreciated that variations and modifications to the operation of nozzle assembly 200 may be made while remaining within the scope of the present disclosure. For example, FIG. 2 illustrates nozzle housing 208 and extendable nozzle 202 as being positioned along a back wall 210 and at a center of cabinet 102 along the transverse direction T. By contrast, according to the exemplary embodiments of FIGS. 6 and 7, nozzle housing 208 and extendable nozzle 202 are illustrated as being positioned along a front wall 211 of cabinet 102 at a corner 212 or lateral side along the lateral direction L. However, either embodiment may be positioned at any other suitable location or locations within washing machine appliance 100.

Figure 3:
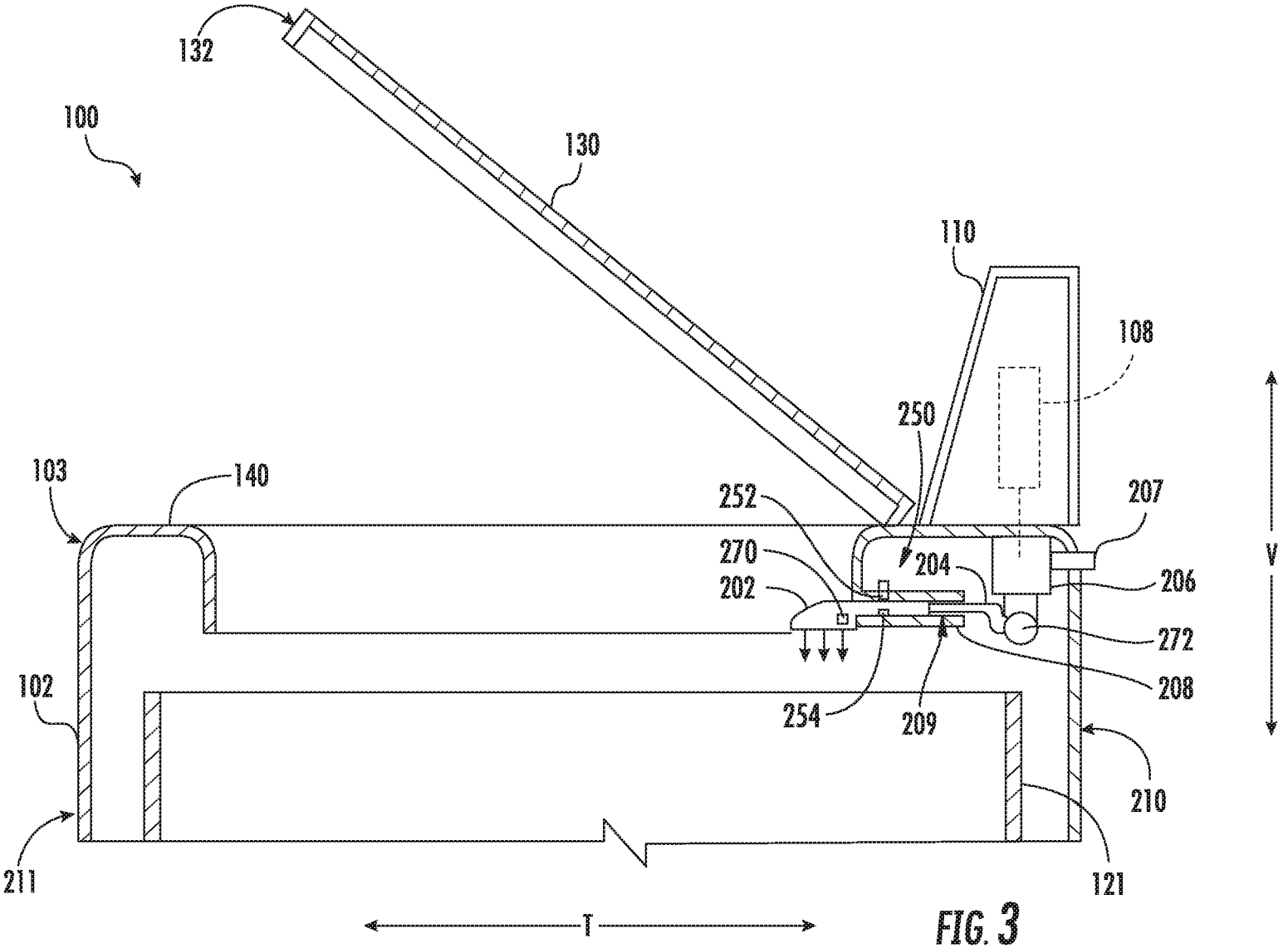
FIG. 3 provides a schematic side, cross-sectional view of a nozzle assembly of the exemplary washing machine appliance of FIG. 1 shown in a retracted position according to an exemplary embodiment of the present disclosure.
Figure 4:
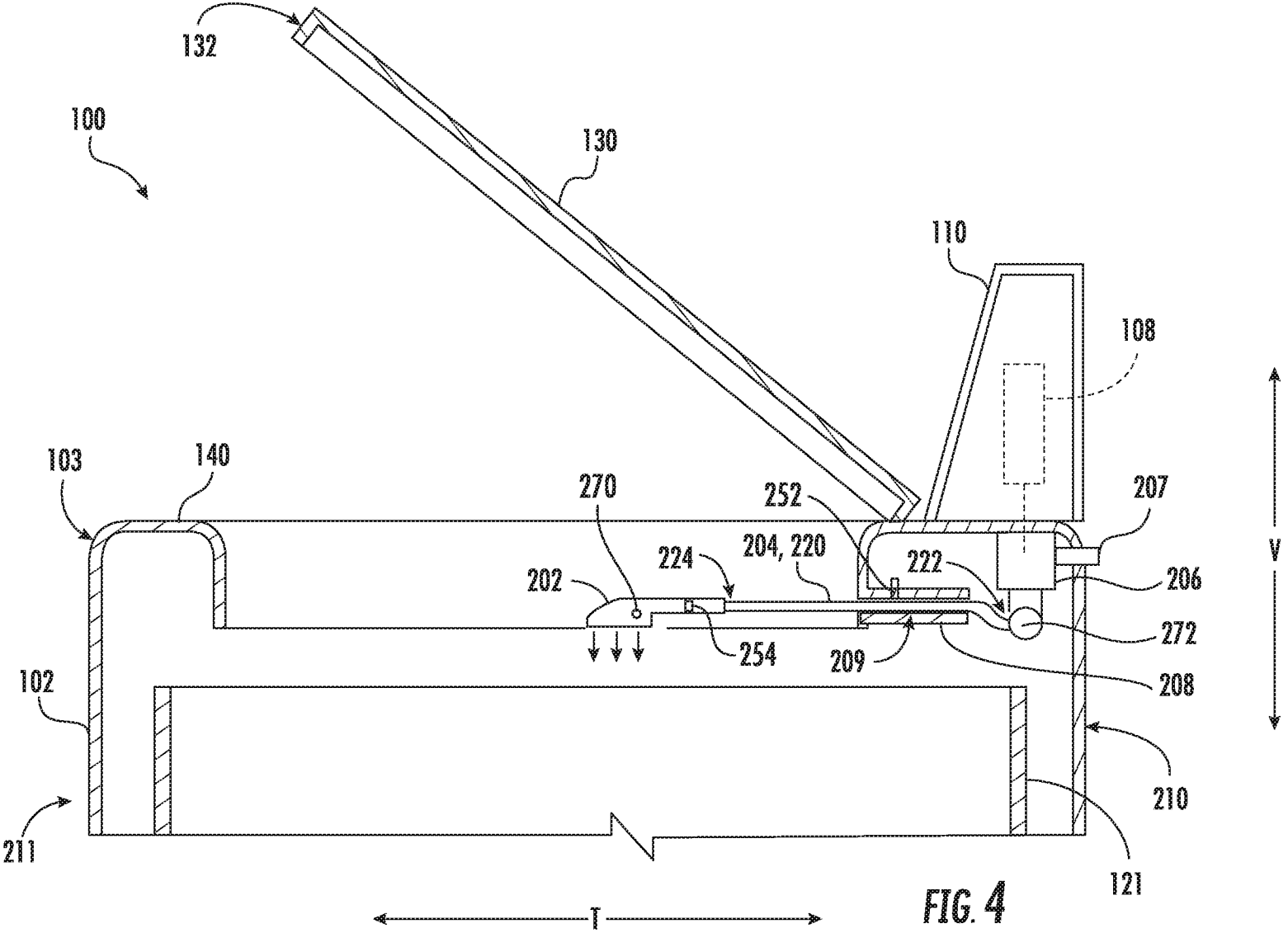
FIG. 4 provides a schematic side, cross-sectional view of the exemplary nozzle assembly of FIG. 3 shown in an extended position.
Figure 5:
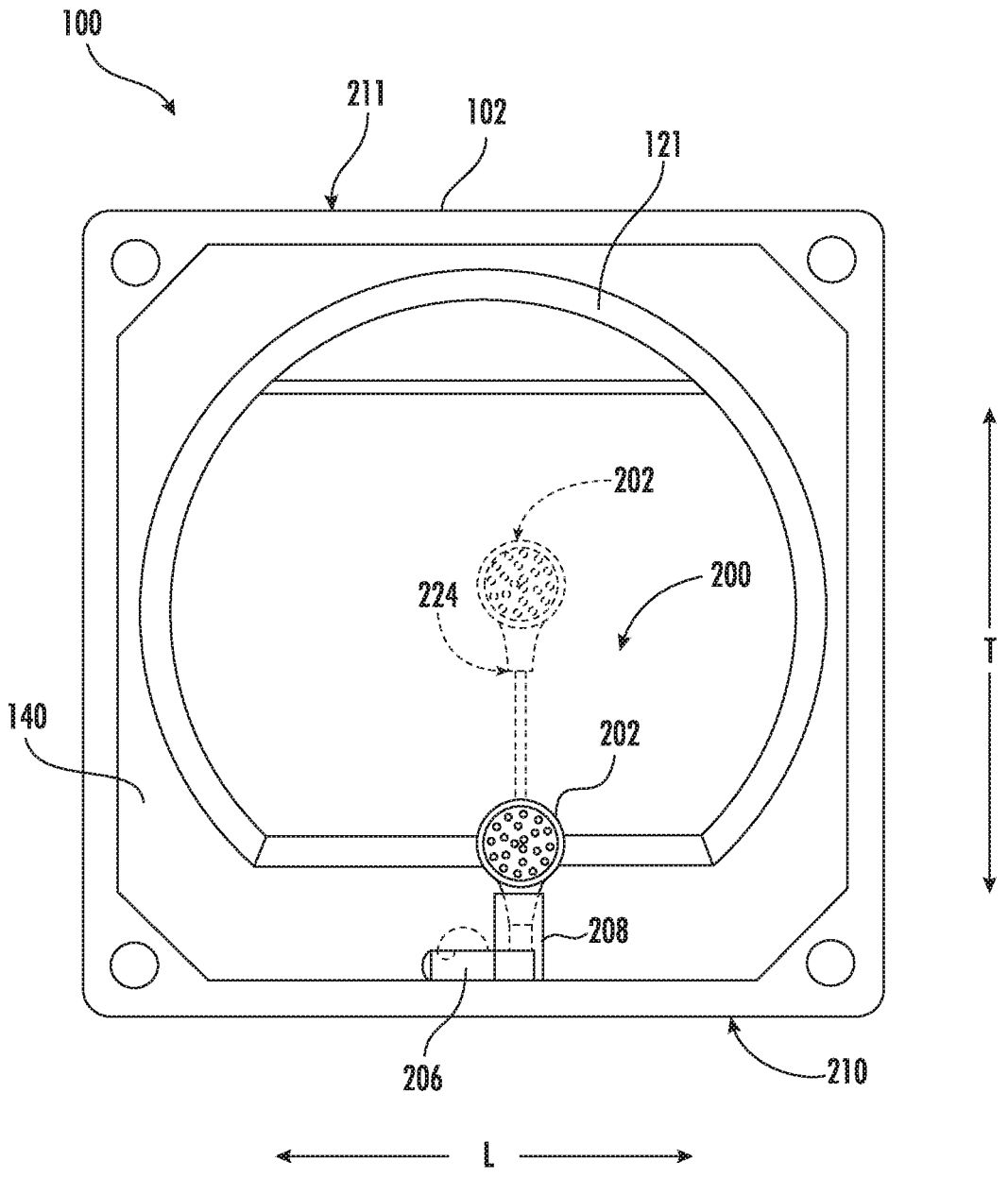
FIG. 5 provides a schematic view of the exemplary nozzle assembly of FIG. 3 shown in both the extended position (in phantom) and the retracted position.

Referring now specifically to FIGS. 3 through 5, retractable fluid supply conduit 204 includes a flexible hose 220 having a first end 222 fluidly coupled to valve assembly 206 and a second end 224 fluidly coupled to extendable nozzle 202. Flexible hose 220 may be any size sufficient to provide wash fluid at the desired flow rate and may be any length suitable for providing a user with flexibility in directing wash fluid to desired portions of wash tub 121 (or otherwise performing a pretreating operation for articles in or near wash tub 121). For example, flexible hose 220 may extend along the entire depth of washing machine appliance 100 along the transverse direction T. Alternatively, according to the illustrated embodiments, flexible hose 220 may only extend about half way into wash tub 121 within a vertical plane when in the extended position (see FIGS. 4 and 5). In this manner, the likelihood of extendable nozzle 202 spraying wash fluid outside of wash tub 121 is reduced. Optionally, one or more retraction mechanisms (not pictured), such as a weighted loop on (e.g., directly or indirectly on) flexible tube or a mechanical spring that extends from nozzle housing 208 to extendable nozzle 202, may be provided to urge or bias extendable nozzle 202 toward the retracted position (see FIG. 3).

Figure 6:
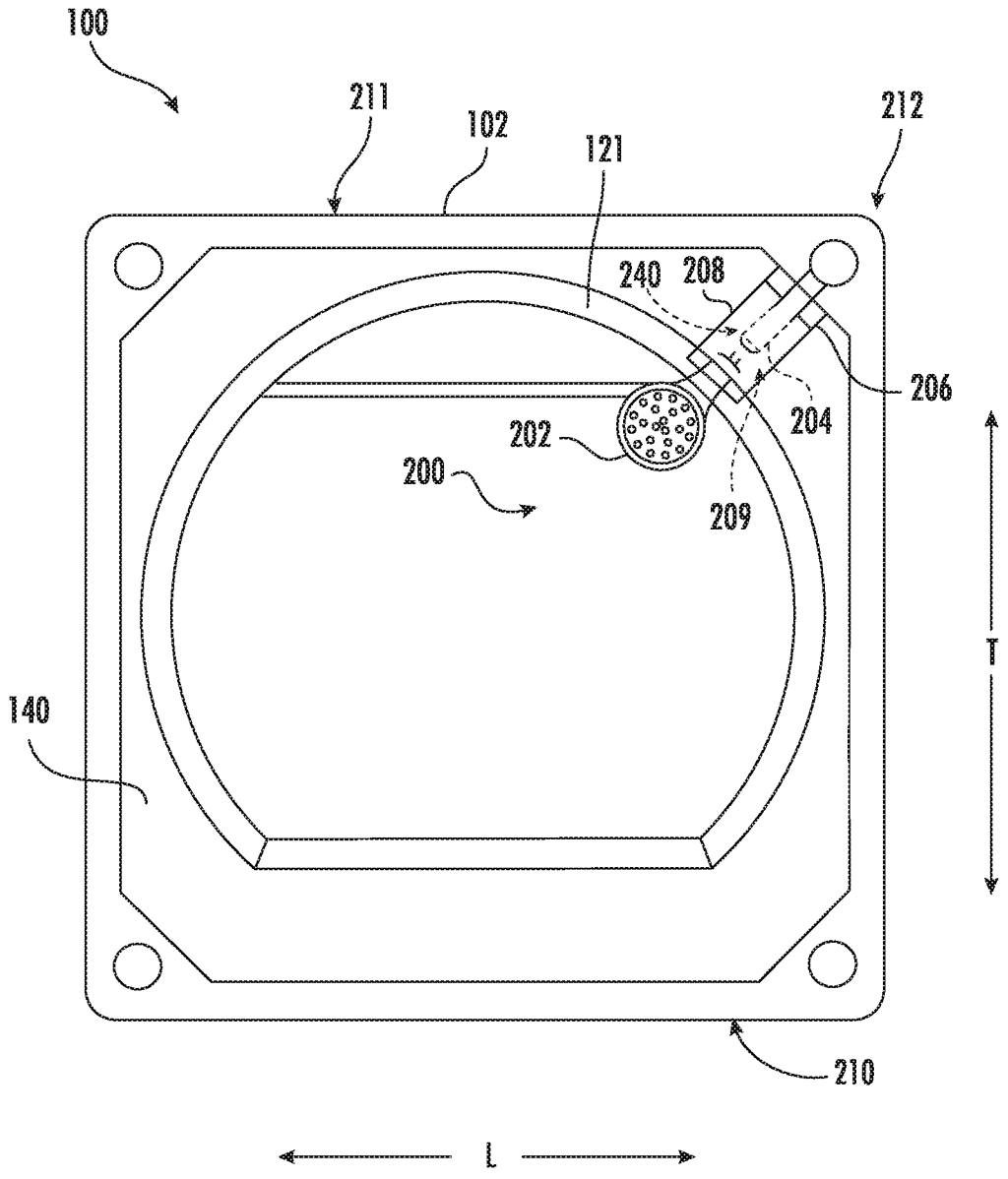
FIG. 6 provides a schematic view of a nozzle assembly of the exemplary washing machine appliance of FIG. 1 shown in a retracted position according to another exemplary embodiment of the present disclosure.
Figure 7:
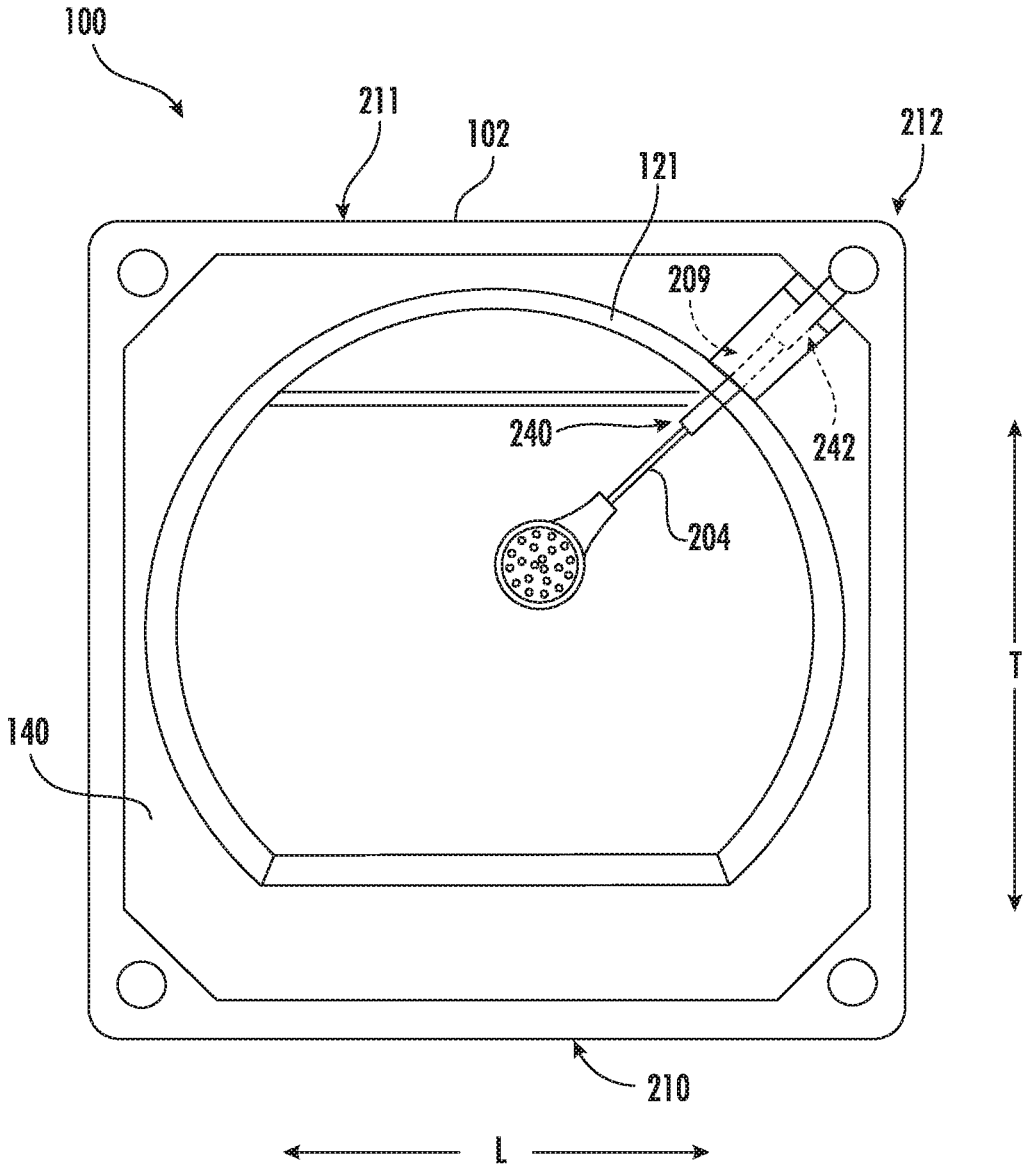
FIG. 7 provides a schematic view of the exemplary nozzle assembly of FIG. 6 shown in an extended position.

Referring now to FIGS. 6 and 7, according to an alternative embodiment of the present disclosure, retractable fluid supply conduit 204 is a telescoping arm 240. As illustrated, telescoping arm 240 includes two or more telescoping sections 242 that are concentric to each other and may slide relative to each other as extendable nozzle 202 is moved between the extended position (see FIG. 7) and the retracted position (see FIG. 6). According to the illustrated embodiment, telescoping sections 242 of telescoping arm 240 actually function as the fluid conduit for providing a flow of wash fluid to extendable nozzle 202. However, it should be appreciated that according to alternative embodiments, a flexible tube or conduit may be positioned within and supported by telescoping arm 240.

In some embodiments, telescoping sections 242 engage each other such that telescoping arm 240 and extendable nozzle 202 extends only in a single vertical plane above wash tub 121. In this manner, the risk of dropping extendable nozzle 202 into wash tub 121 may be reduced or eliminated. In addition, a user may move extendable nozzle 202 to the extended position and then be free to use two hands underneath extendable nozzle 202 (e.g., to, scrub, work, or otherwise clean an article of clothing). In order to further facilitate easy cleaning of articles of clothing, according to exemplary embodiments, extendable nozzle 202 may include one or more lights, such as light emitting diodes (LEDs), positioned on (e.g., directly or indirectly on) extendable nozzle 202 and configured for illuminating when extendable nozzle 202 is moved toward the extended position.

According to the illustrated embodiments of FIGS. 6 and 7, telescoping arm 240 includes three sections 242 and extends from a corner 212 of cabinet 102. In this manner, more space is provided to accommodate telescoping arm 240 and nozzle assembly 200 between wash tub 121 and cabinet 102. It should be appreciated that the size, position, number and size of sections 242, and general configuration of telescoping arm 240 may vary according to alternative embodiments. For example, telescoping arm 240 could extend from the back center of cabinet 102. Alternatively, retractable fluid supply conduit 204 could be a fixed length arm that is connected in back corner 212 of cabinet 102 and pivots (e.g., pivots 45 degrees between a first position where extendable nozzle 202 is positioned at a back center of cabinet 102 to a second position where extendable nozzle 202 is positioned over a center of wash tub 121) within a vertical plane. Moreover, other configurations are possible and within the scope of the present disclosure.

Referring again to FIGS. 3 and 4, nozzle assembly 200 may further include a sensing system 250 for detecting whether extendable nozzle 202 is in the retracted position. In this regard, for example, sensing system 250 includes a hall-effect sensor 252 mounted at a fixed position within nozzle housing 208 and a magnet 254 positioned on second end 224 of flexible hose 220 or directly on extendable nozzle 202. In this manner, when extendable nozzle 202 is in the retracted position, hall-effect sensor 252 can detect the proximity of magnet 254 and controller 108 may determine that extendable nozzle 202 is in the retracted position. Alternatively, any other suitable sensors or methods of detecting the position of extendable nozzle 202 may be used. For example, motion sensors, camera systems, or simple mechanical contact switches may be used according to alternative embodiments.

In some situations, a user may wish to add additional water to wash tub 121 or add a particular wash fluid for a pretreat operation. For example, a user may wish to prewash one or more articles of clothing or may perceive that more water is needed to effectively wash a load. In order to provide a user with control over the flow of wash fluid being dispensed through extendable nozzle 202, nozzle assembly 200 may further include one or more user input buttons 270 for adding a wash fluid to wash tub 121. User input buttons 270 may be operably coupled with controller 108 and/or valve assembly 206 for controlling the flow of wash fluid. According to the illustrated embodiment, user input button 270 is located on extendable nozzle 202 for easy access by an operator. However, according to alternative embodiments, user input button 270 may be positioned at any other suitable location or locations.

As shown in FIGS. 3 and 4, valve assembly 206 generally includes a plurality of valves 272 configured to supply, for example, hot water, cold water, warm water, a mixture of water and detergent, other wash additives, etc. According to exemplary embodiments, user input buttons 270 are configured for controlling one or more of the plurality of valves 272 that can be turned on/off independently or together in any combination. Valves 272 may be, for example, solenoid valves that are electrically connected to controller 108. However, any other suitable water valve may be used to control the flow of water or wash fluid. Controller 108 may selectively open and close water valves 272 to allow water or wash fluid to flow from hot water inlet, cold water inlet, detergent inlet, softener inlet, or any other suitable fluid through a respective valve seat. Valve assembly 206 or nozzle housing 208 may further include a one or more detergent storage compartments, mixing chambers, or other features within which a fluid additive (e.g., powdered or liquid detergent) can mix with hot or cold water prior to being dispensed out of the extendable nozzle 202.

User input button 270 may be any button or switch suitable for providing an indication to controller 108 that a particular action should be initiated. For example, buttons 270 may be push button switches, toggle switches, rocker switches, or any other suitable tactile switch, such as capacitive touch buttons. According to the illustrated embodiments, buttons 270 are momentary switches (sometimes referred to as mom-off-mom switches). In this regard, buttons 270 are biased switches that return to their unlatched or unpressed state when released (e.g., by spring force).

It should be appreciated that the amount of water or wash fluid added to wash tub 121 upon pressing buttons 270 may vary depending on the application or wash cycle. Similarly, the amount of water delivered may be preset such that pressing buttons 270 delivers the predetermined amount of water. Alternatively, valves 272 may be configured to remain open at all times when corresponding buttons 270 are depressed. In this manner, a user may precisely control the amount of water added to wash tub 121.

Turning now to FIGS. 8 through 15, several schematic side, cross-sectional views of extendable nozzle 202 are shown, according to exemplary embodiments. As shown, extendable nozzle 202 defines a vertical direction V', which is understood to be parallel to corresponding vertical direction V (FIGS. 1 through 4), for example, when extendable nozzle 202 is in the retracted position. Although FIG. 8 through 15 illustrate features of multiple embodiments, it is understood that, except as otherwise indicated, none of the exemplary embodiments of FIGS. 8 through 15 are understood to be mutually-exclusive. In other words, various features of one or more embodiments may be incorporated into one or more other embodiments, as would be generally understood. For instance, one or more features illustrated in one figure may be provided in the embodiment illustrated in another figure.

As shown, especially in FIGS. 8 through 12, extendable nozzle 202 includes a nozzle body 310 defining a nozzle inlet 312 and a nozzle outlet 314. Nozzle inlet 312 is generally connected to fluid supply conduit 204 (FIG. 3) (e.g., in fluid communication with fluid supply conduit 204). Nozzle outlet 314 may include one or more spray ports or apertures and provides an output or exhaust for wash fluid from extendable nozzle 202. Within extendable nozzle 202 (e.g., within nozzle body 310), a fluid path 316 is defined between nozzle inlet 312 and nozzle outlet 314. For instance, one or more conduits or defined channels may be provided within extendable nozzle 202 to direct the flow of wash fluid. Thus, water or wash fluid entering extendable nozzle 202 at nozzle inlet 312 may flow along fluid path 316 before exiting extendable nozzle 202 (e.g., into the tub 121—FIG. 2) at nozzle outlet 314.

During certain conditions, it may be desirable to provide one or more additives to water or wash fluid being output from extendable nozzle 202. In some embodiments, an additive cavity 318 is defined within extendable nozzle 202 (e.g., within nozzle body 310) to hold a wash additive (e.g., granular or fluid additives, such as detergent, bleach, fabric softener, etc.) to be added or mixed with water or wash fluid in extendable nozzle 202. Specifically, additive cavity 318 is defined in fluid communication with fluid path 316 at a location downstream from nozzle inlet 312. For instance, one or more additives may be selectively supplied to fluid path 316 from additive cavity 318. Within extendable nozzle 202, additives may thus mix with the water or wash fluid from nozzle inlet 312, before being expelled as a modified wash fluid from nozzle outlet 314.

Figure 8:
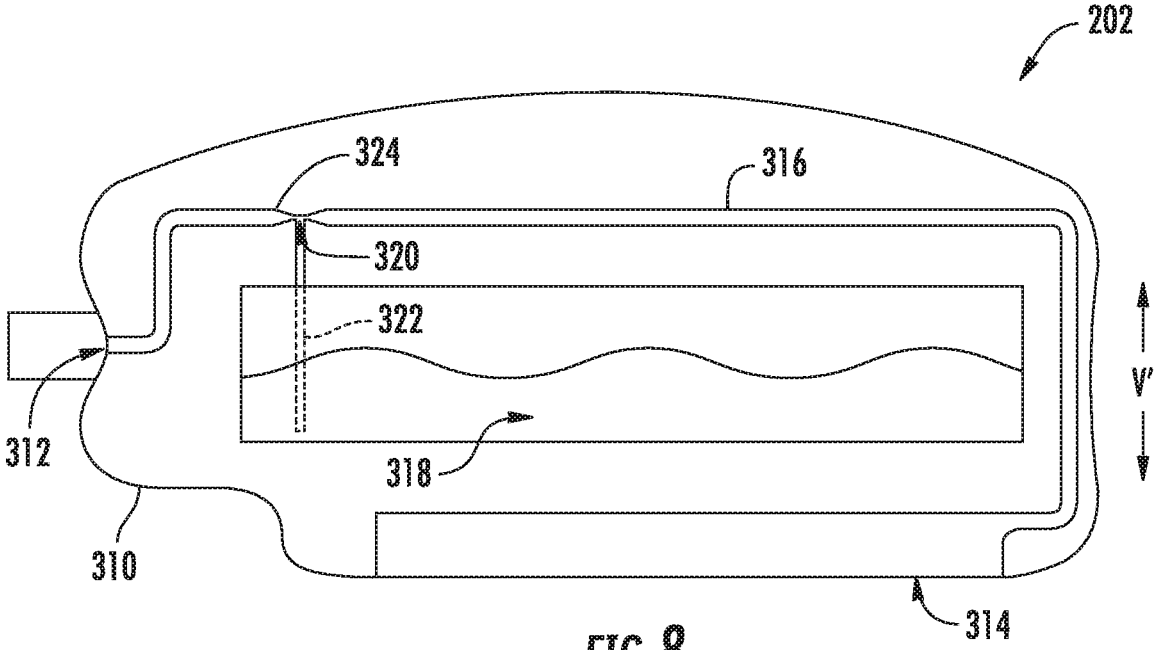
FIG. 8 provides a schematic side, cross-sectional view of an extendable nozzle according to exemplary embodiments of the present disclosure.

Turning specifically to FIG. 8, exemplary embodiments of extendable nozzle 202 have additive cavity 318 spaced apart from fluid path 316 (e.g., along the vertical direction V'). An intake opening or aperture 320 may be defined along fluid path 316 between nozzle inlet 312 and nozzle outlet 314. Through intake aperture 320, one or more additives may be selectively supplied to fluid path 316 from additive cavity 318. For instance, between additive cavity 318 and fluid path 316, a feed line 322 may be positioned. Feed line 322 may extend from fluid path 316 into additive cavity 318.

In some embodiments, feed line 322 defines a siphon channel that draws in wash additive from additive cavity 318 when water or wash fluid flows through fluid path 316. More particularly, as water is supplied through fluid path 316 to nozzle outlet 314, the flowing fluid creates a negative pressure within feed line 322. This negative pressure may draw in wash additive from additive cavity 318 (e.g., in proportion to the amount of fluid flowing through feed line 322). Feed line 322 and aperture 320 may be calibrated according to a desired amount of wash additive. For instance, the siphon channel of feed line 322 and aperture 320 may be sized and shaped to provide a selected flow rate (e.g., volumetric flow rate) of the wash additive. The selected flow rate of the wash additive may be set according to a predetermined flow rate or pressure through the fluid path 316. Notably, during operation, the selected flow rate of any wash additive from additive cavity 318 may be proportional to the predetermined flow rate of wash fluid through fluid path 316.

In certain embodiments, feed line 322 is fluidly connected to fluid path 316 through a Venturi nozzle 324. For instance, Venturi nozzle 324 may positioned downstream from nozzle inlet 312 and upstream from nozzle outlet 314 at intake aperture 320. Moreover, Venturi nozzle 324 receives the siphon channel of feed line 322. The feed line 322 and Venturi nozzle 324 may be configured (e.g., sized and shaped) to ensure the desired amount of wash additive is supplied for a given water flow rate through fluid path 316. For example, by adjusting the diameter of feed line 322 and the flow restriction of Venturi nozzle 324, the volumetric flow rate of wash additive may be adjusted.

Figure 9:
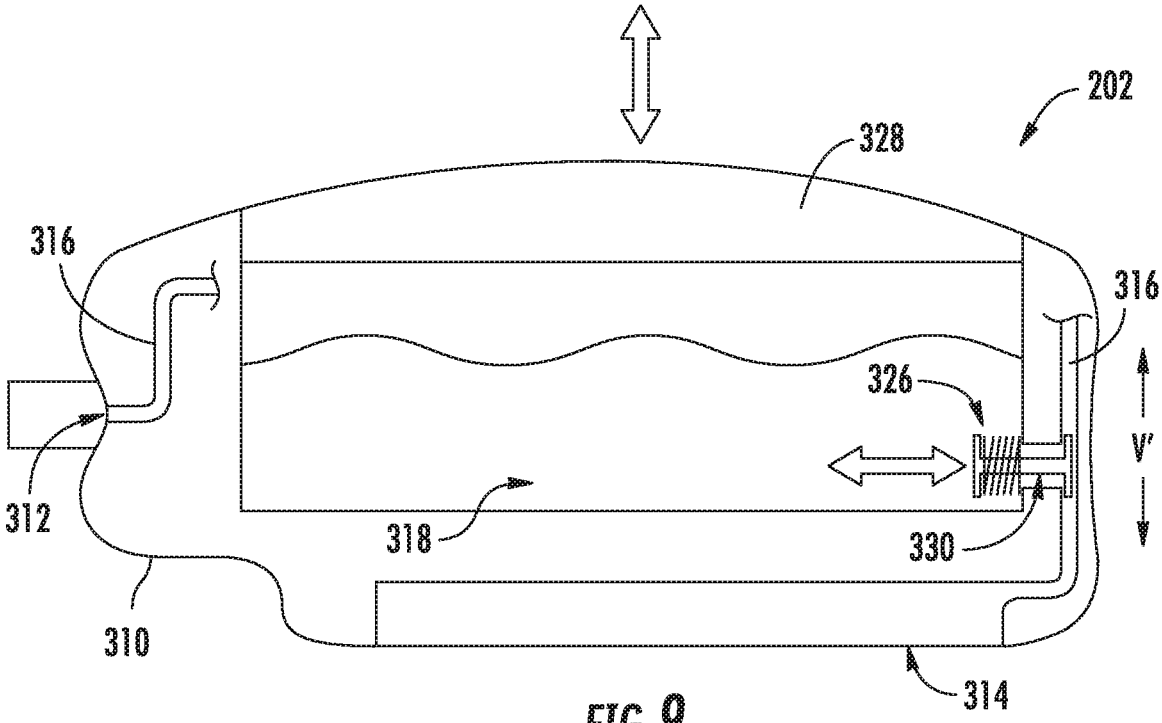
FIG. 9 provides a schematic side, cross-sectional view of an extendable nozzle according to exemplary embodiments of the present disclosure.

Turning specifically to FIG. 9, exemplary embodiments of extendable nozzle 202 include additive cavity 318 at a position spaced apart from fluid path 316 (e.g., along any suitable direction, such as vertical direction V'). One or more valves (e.g., additive valve 326) may permit selective fluid communication between additive cavity 318 and fluid path 316. For instance, the one or more additive valves 326 may be positioned in fluid communication between additive cavity 318 and fluid path 316. During use, the valve(s) 326 may be selectively adjusted to control communication between additive cavity 318 and fluid path 316. In some such embodiments, the valve(s) 326 is/are alternately opened and closed to respectively permit and prevent wash additive to pass from additive cavity 318 to fluid path 316 (and, subsequently, to nozzle outlet 314). Opening and closing of valve(s) 326 may be controlled by any suitable user input. For instance, a user-depressible input 328 may be in operative communication with additive cavity 318. Movement of input 328 may cause valve to open or close, thereby controlling or directing wash additive from additive cavity 318 to fluid path 316.

In some embodiments, additive valve 326 is provided as a resilient valve, for example, biased toward a closed position. As an example, additive valve 326 may include a biasing spring and plunger positioned about or through a corresponding port or passage 330 that fluidly connects additive cavity 318 and fluid path 316. As an additional or alternative example, additive valve 326 may include an elastic check valve formed, at least in part, from an elastic biasing polymer. However, any other suitable resilient valve may be provided to selectively permit wash additive to flow from additive cavity 318 to fluid path 316. In some such embodiments, user-depressible input 328 is provided as a manual pump in operative communication with additive cavity 318. Inward movement of the user-depressible input 328 toward additive cavity 318 may thus increase the pressure within additive cavity 318 and motivate resilient valve 326 to an open position, permitting wash additive therethrough, before a biasing element of the resilient valve 326 returns the resilient valve 326 to a closed position. Notably, wash additive may be selectively added in discrete amounts or volumes to wash fluid through nozzle 202.

Figure 10:
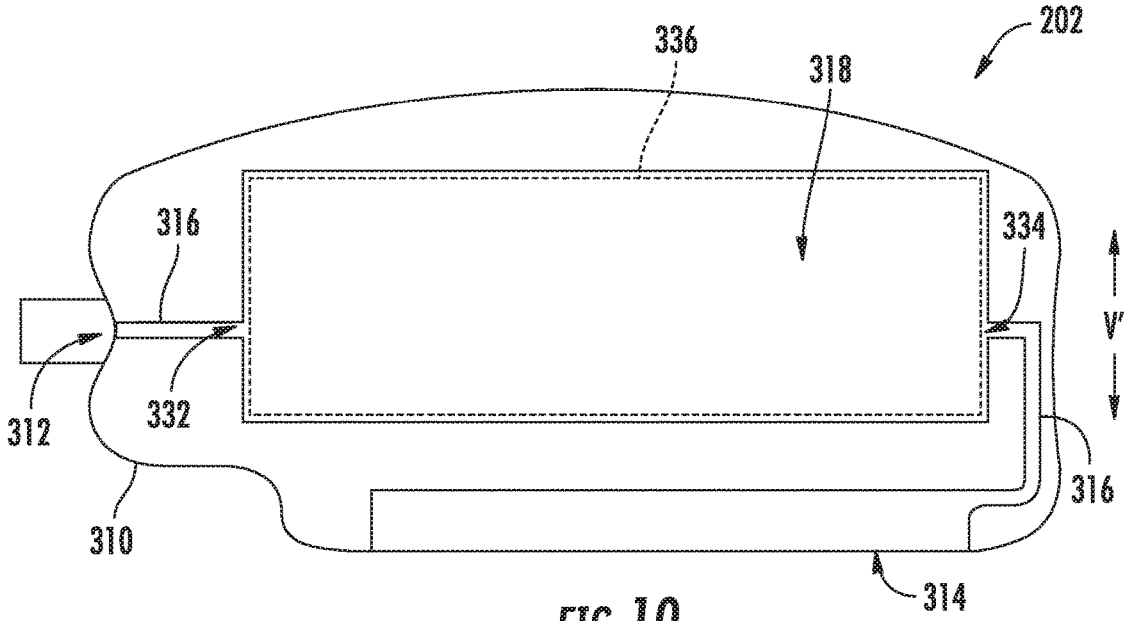
FIG. 10 provides a schematic side, cross-sectional view of an extendable nozzle according to exemplary embodiments of the present disclosure.

Turning specifically to FIG. 10, exemplary embodiments of extendable nozzle 202 include additive cavity 318 at a position in line with fluid path 316. In particular, additive cavity 318 includes a discrete cavity entrance 332 and a discrete cavity exit 334 that are positioned in fluid series along fluid path 316. Thus, wash fluid may flow from nozzle inlet 312 and through cavity entrance 332 before the wash fluid is received within a defined volume of additive cavity 318. As shown, the defined volume of additive cavity 318 may define an enlarged diameter that is, optionally, greater than a maximum diameter of the fluid path 316 (e.g., a maximum diameter between nozzle inlet 312 and cavity entrance 332 or between cavity exit 334 and nozzle outlet 314). Within additive cavity 318, the received wash fluid and wash additive may mix before passing through cavity exit 334 and to nozzle outlet 314. Optionally, wash additive may be provided as or within a self-contained pod 336 that can be selectively added to or removed from additive cavity 318.

Figure 11:
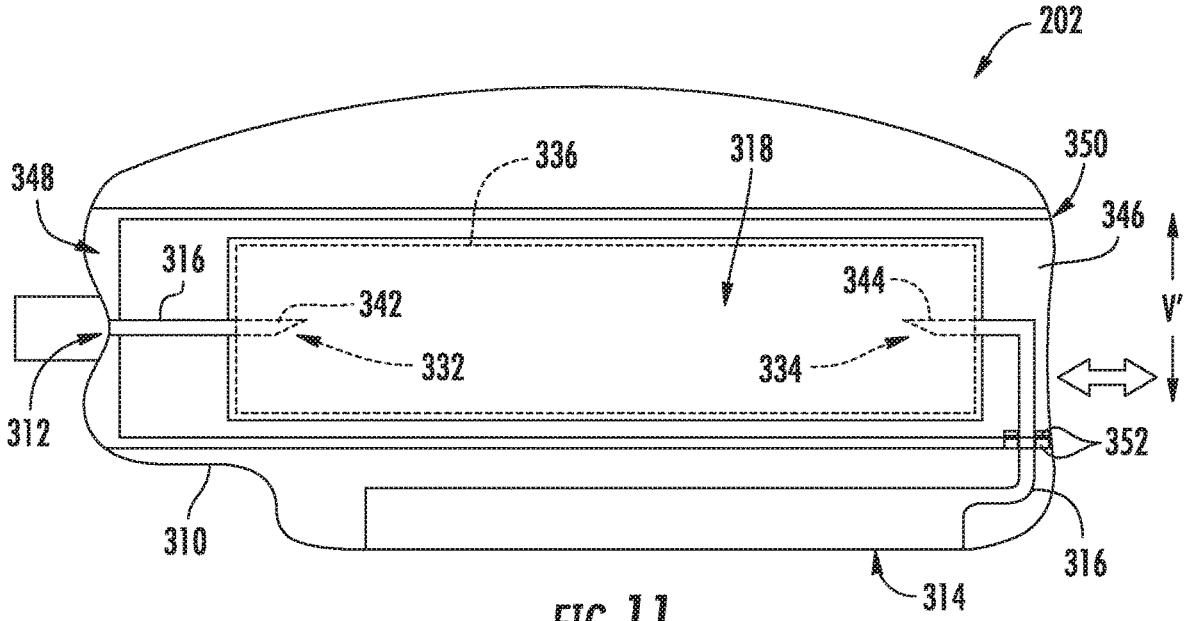
FIG. 11 provides a schematic side, cross-sectional view of an extendable nozzle according to exemplary embodiments of the present disclosure.

Turning specifically to FIG. 11, exemplary embodiments of extendable nozzle 202 include additive cavity 318 at a movable position in line with fluid path 316. In particular, additive cavity 318 includes a discrete cavity entrance 332 and a discrete cavity exit 334 that are positioned in fluid series along fluid path 316. In some embodiments, one or both of cavity entrance 332 and cavity exit 334 may receive a sharpened conduit prong (e.g., needle), such as an inlet prong 342 or an outlet prong 344. When received, the sharpened conduit prong (e.g., inlet prong 342 or outlet prong 344) defines a portion of the fluid path 316 between nozzle inlet 312 and nozzle outlet 314. In certain embodiments, a discrete inlet prong 342 and outlet prong 344 are provided, as illustrated. Optionally, inlet prong 342 may be a stationary fixed member (e.g., stationary relative to nozzle body 310) upstream from additive cavity 318, while outlet prong 344 is movable (e.g., slidable or pivotable) relative to a portion of nozzle body 310 and is positioned downstream from additive cavity 318.

In certain embodiments, a slidable tray 346 is selectively received within nozzle body 310. For instance, slidable tray 346 may slide (e.g., in a direction perpendicular to vertical direction V') into and out of a receiving chamber 348 defined by nozzle body 310. In other words, slidable tray 346 may move through an additive opening 350 between an open location wherein at least a portion of slidable tray 346 is positioned outside of receiving chamber 348, and a closed location wherein slidable tray 346 is positioned within receiving chamber 348. Additive cavity 318 may be at least partially defined by slidable tray 346. Thus, wash additive may be supplied to additive cavity 318 (e.g., as a pod 336) when tray is at the open location. When tray is at the closed location, prongs 342, 344 pierce or extend into additive cavity 318, fluidly connecting fluid path 316 between nozzle inlet 312 and nozzle outlet 314.

In optional embodiments, outlet prong 344 is movably attached to nozzle body 310. For instance, outlet prong 344 may be positioned on slidable tray 346 (e.g., to move therewith). As shown, one or more O-rings or gaskets 352 may be provided between outlet prong 344 and nozzle body 310, ensuring a fluid seal is maintained from outlet prong 344 to nozzle outlet 314 (e.g., when slidable tray 346 is at the closed location).

Figure 12:
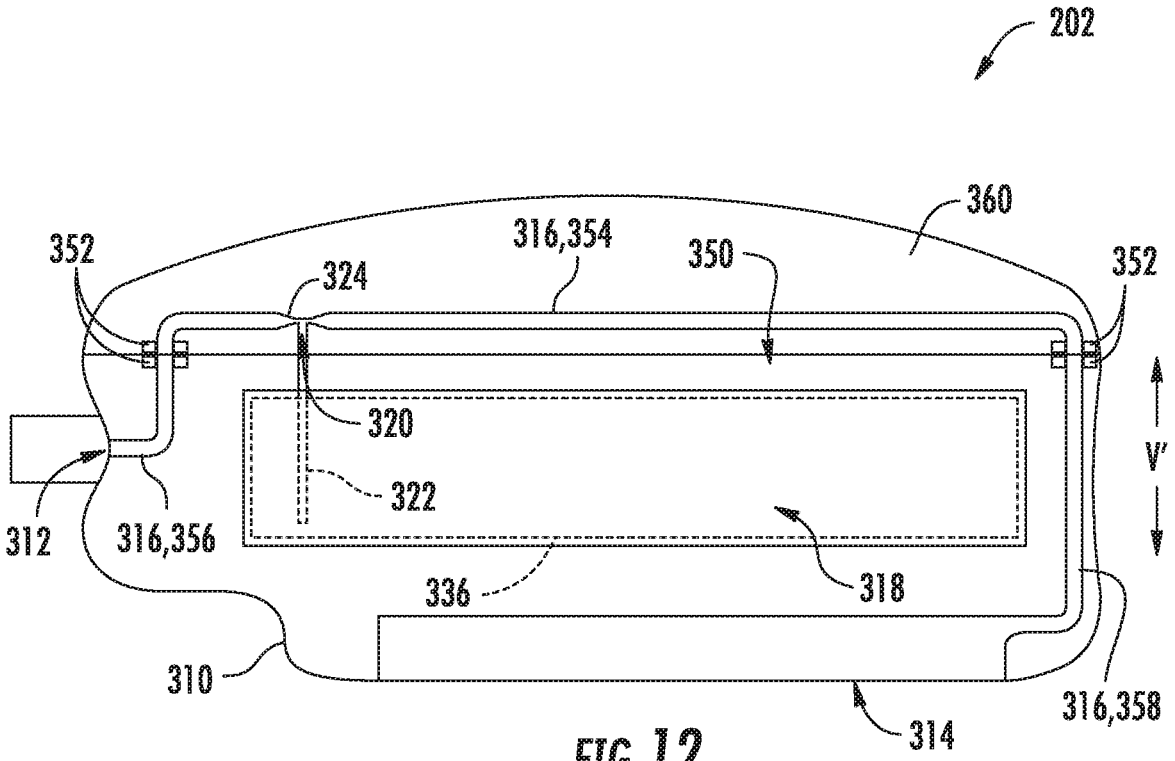
FIG. 12 provides a schematic side, cross-sectional view of an extendable nozzle according to exemplary embodiments of the present disclosure.

Turning specifically to FIG. 12, exemplary embodiments of extendable nozzle 202 include additive cavity 318 at a position spaced apart from fluid path 316 (e.g., along the vertical direction V'). As shown, in some such embodiments, fluid path 316 is defined by three or more discrete portions (e.g., channels or conduits). For instance, an intermediate portion 354 may be selectively positionable between two end portions 356, 358. End portions 356, 358 may be defined or positioned within extendable nozzle 202 (e.g., proximal to nozzle inlet 312 and nozzle outlet 314, respectively). Intermediate portion 354 may be positioned or defined within a removable lid 360 that is selectively mounted to nozzle body 310. When lid 360 is closed on nozzle body 310, intermediate portion 354 may thus fluidly connect one end portion 356 to the other end portion 358. When lid 360 is open or otherwise moved apart from nozzle body 310, wash additive may be supplied to additive cavity 318 (e.g., as a pod 336 through an additive opening 350). As shown, one or more O-rings or gaskets 352 may be provided between intermediate portion 354 and nozzle body 310, ensuring a fluid seal is maintained at the point of connection between intermediate portion 354 and each end portion 356, 358 (e.g., when lid 360 is closed).

In some embodiments, a feed line 322 may extend from fluid path 316 (e.g., from intermediate portion 354) into additive cavity 318 when lid 360 is closed on nozzle body 310. Optionally, feed line 322 may be provided as a sharpened conduit prong (e.g., needle). Additionally or alternatively, feed line 322 may define a siphon channel that draws in wash additive from additive cavity 318 when water or wash fluid flows through fluid path 316. More particularly, as water is supplied through fluid path 316 to nozzle outlet 314, the flowing fluid creates a negative pressure within feed line 322. This negative pressure may draw in wash additive from additive cavity 318 (e.g., in proportion to the amount of fluid flowing through feed line 322). Feed line 322 and aperture 320 may be calibrated according to a desired amount of wash additive. For instance, the siphon channel of feed line 322 and aperture 320 may be sized and shaped to provide a selected flow rate (e.g., volumetric flow rate) of the wash additive. The selected flow rate of the wash additive may be set according to a predetermined flow rate or pressure through the fluid path 316. Notably, during operation, the selected flow rate of any wash additive from additive cavity 318 may be proportional to the predetermined flow rate of wash fluid through fluid path 316.

In certain embodiments, feed line 322 is fluidly connected to fluid path 316 through a Venturi nozzle 324. For instance, Venturi nozzle 324 may positioned downstream from nozzle inlet 312 and upstream from nozzle outlet 314 at intake aperture 320. Moreover, Venturi nozzle 324 receives the siphon channel of feed line 322. The feed line 322 and Venturi nozzle 324 may be configured (e.g., sized and shaped) to ensure the desired amount of wash additive is supplied for a given water flow rate through fluid path 316. For example, by adjusting the diameter of feed line 322 and the flow restriction of Venturi nozzle 324, the volumetric flow rate of wash additive may be adjusted.

As shown, especially at FIGS. 13 through 16, nozzle body 310 generally defines an additive opening 350 in selective communication with additive cavity 318. As shown, additive opening 350 may be in parallel (e.g., fluid parallel) with nozzle inlet 312 (see e.g., FIGS. 8 through 12). Thus, wash additive may be supplied to additive cavity 318 through additive opening 350.

Figure 13:
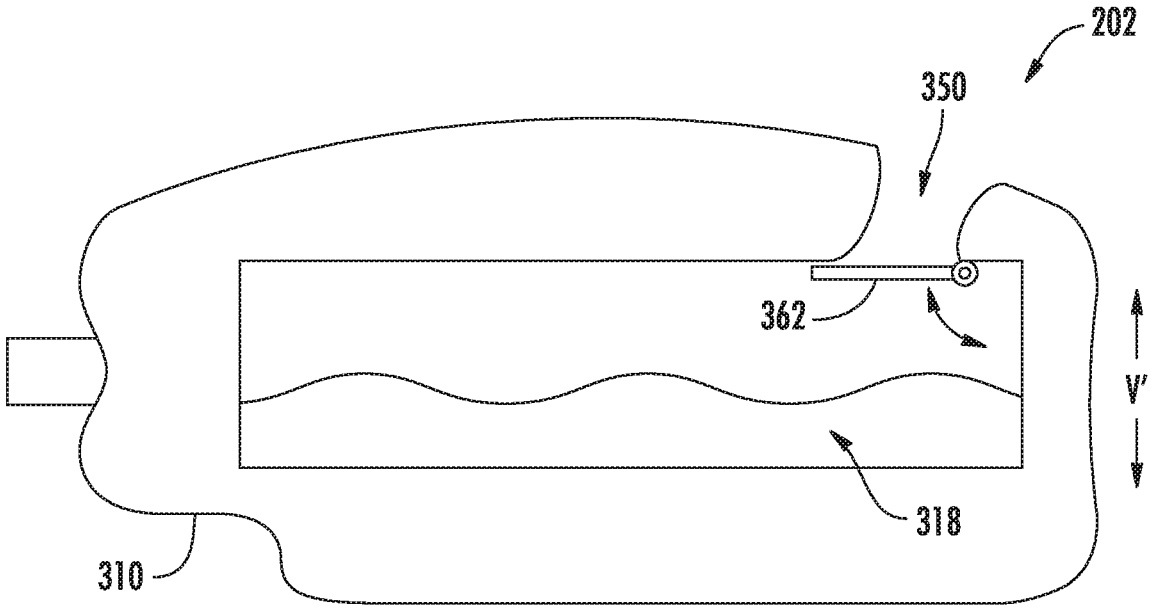
FIG. 13 provides a schematic side, cross-sectional view of an extendable nozzle according to exemplary embodiments of the present disclosure.

Turning specifically to FIG. 13, exemplary embodiments of extendable nozzle 202 have a biased door 362 that selectively covers additive opening 350. For instance, biased door 362 may be mounted to nozzle body 310 (e.g., above additive cavity 318) and biased toward a sealed position (illustrated in FIG. 13) wherein additive opening 350 is covered and wash additive is prevented from flowing through additive opening 350. An outside force, such as one provided by a user, may move biased door 362 to an unsealed position where additive opening 350 is not covered and wash additive may be flowed through additive opening 350. Thus wash additive may be provided to additive cavity 318 when biased door 362 is in the unsealed position.

Optionally, biased door 362 may include a biasing spring mounted to a solid rotating member (e.g., flap). Additionally or alternatively, biased door 362 may be formed, at least in part, from an elastic biasing polymer. Moreover, any other suitable biasing member may be provided to selectively permit wash additive to flow to additive cavity 318 through additive opening 350 before returning biased door 362 to the sealed position.

Figure 14:
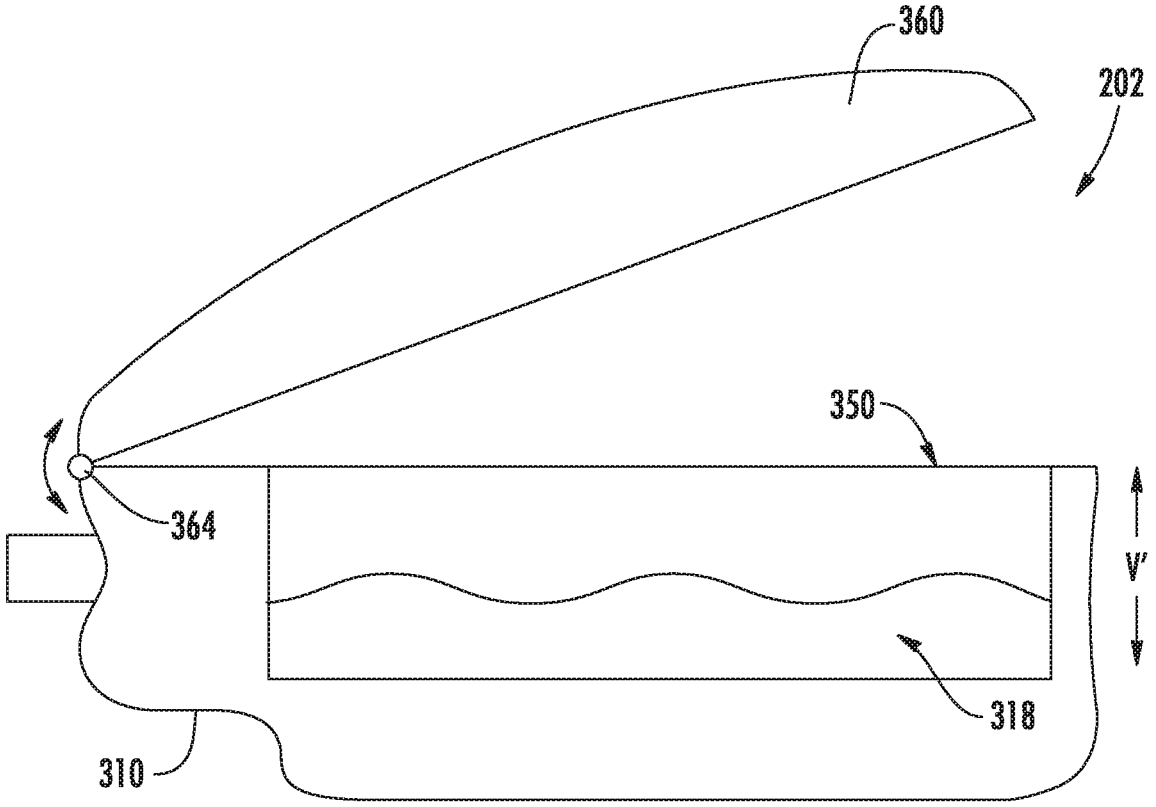
FIG. 14 provides a schematic side, cross-sectional view of an extendable nozzle according to exemplary embodiments of the present disclosure.

Turning specifically to FIG. 14, exemplary embodiments of extendable nozzle 202 have a lid 360 that is selectively positioned over additive opening 350 to restrict access to additive cavity 318. In some such embodiments, additive opening 350 is defined at a top portion of nozzle body 310 (e.g., along the vertical direction V'). Thus, lid 360 may be mounted on nozzle body 310 at the top portion thereof. As shown, lid 360 may be mounted to a horizontal pin 364 about which lid 360 rotates. Lid 360 may be selectively rotated between an open or unsealed position (illustrated at FIG. 14) and a closed or sealed position. Generally, the unsealed position reveals or uncovers additive opening 350, permitting access thereto, and allowing wash additive to be placed or flowed into additive cavity 318 through additive opening 350. In particular, lid 360 may be lifted above additive opening 350 and away from nozzle body 310 in the unsealed position. By contrast, the sealed position provides lid 360 in engagement (e.g., direct or indirect contact) with nozzle body 310 directly above additive opening 350. Thus, in the sealed position, additive opening 350 is covered and wash additive is prevented from flowing through additive opening 350.

Figure 15:
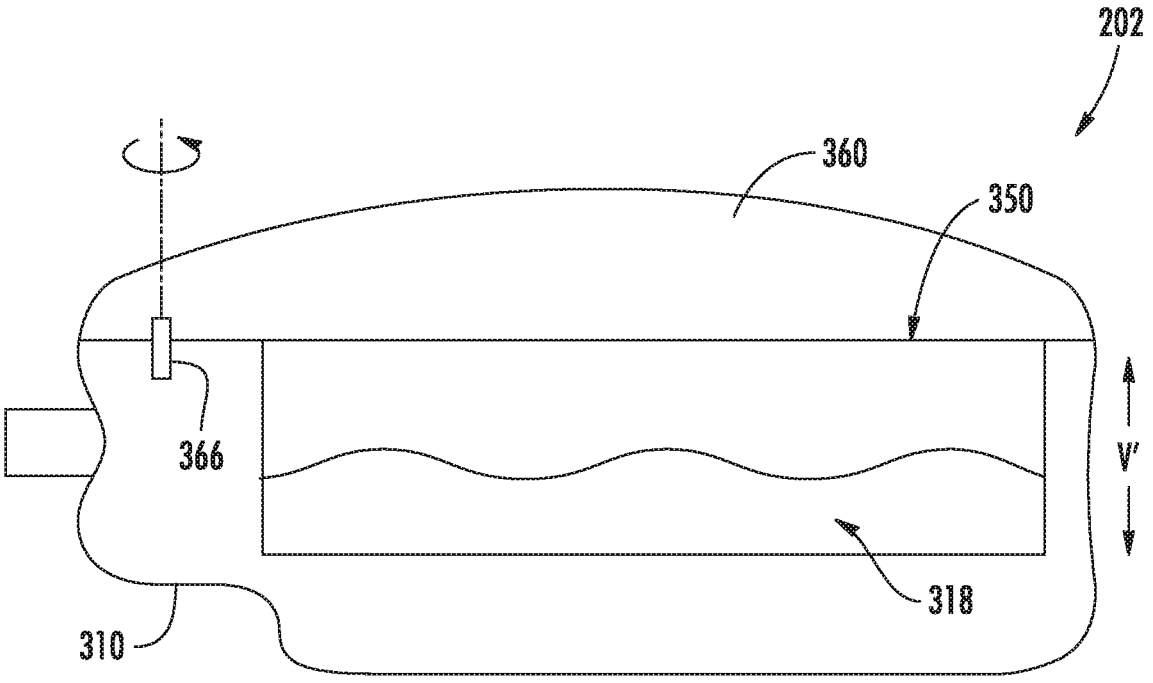
FIG. 15 provides a schematic side, cross-sectional view of an extendable nozzle according to exemplary embodiments of the present disclosure.

Turning specifically to FIG. 15, further exemplary embodiments of extendable nozzle 202 have a lid 360 that is selectively positioned over additive opening 350 to restrict access to additive cavity 318. In some such embodiments, additive opening 350 is defined at a top portion of nozzle body 310 (e.g., along the vertical direction V'). Thus, lid 360 may be mounted on nozzle body 310 at the top portion thereof. As shown, lid 360 may be mounted to a vertical pin 366 about which lid 360 rotates. Lid 360 may be selectively rotated between an open or unsealed position and a closed or sealed position (illustrated at FIG. 15). Generally, the unsealed position reveals or uncovers additive opening 350, permitting access thereto, and allowing wash additive to be placed or flowed into additive cavity 318 through additive opening 350. In particular, lid 360 may be pushed apart from additive opening 350 and rotated horizontally away from nozzle body 310 in the unsealed position. By contrast, the sealed position provides lid 360 in engagement (e.g., direct or indirect contact) with nozzle body 310 directly above additive opening 350. Thus, in the sealed position, additive opening 350 is covered and wash additive is prevented from flowing through additive opening 350.

Figure 16:
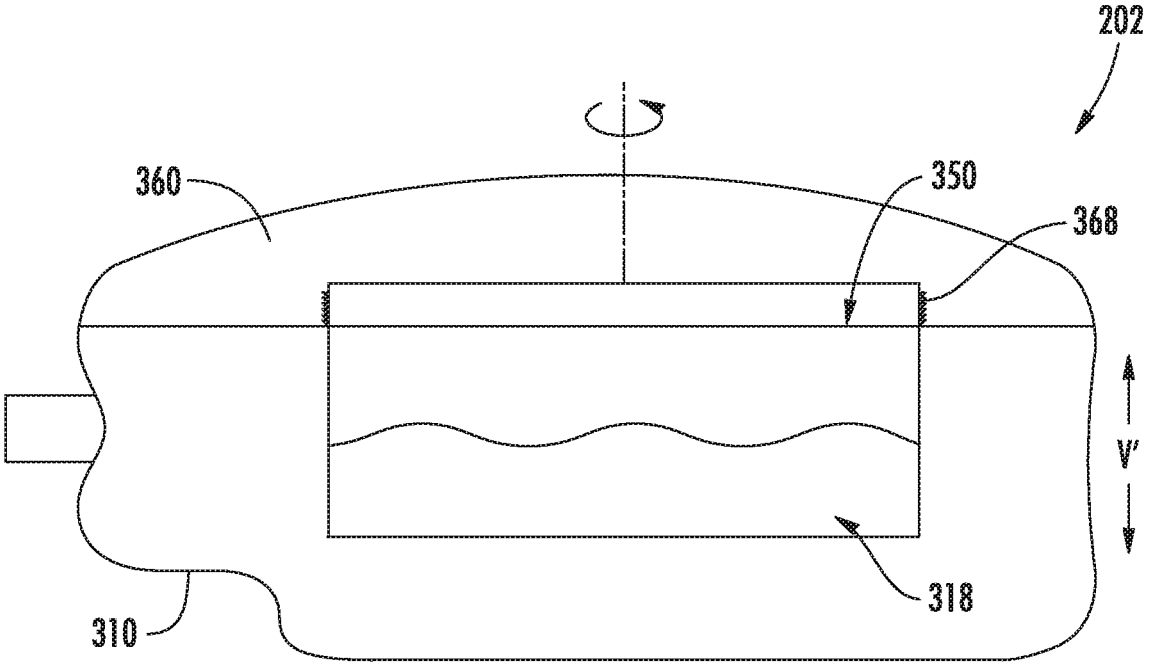
FIG. 16 provides a schematic side, cross-sectional view of an extendable nozzle according to exemplary embodiments of the present disclosure.

Turning specifically to FIG. 16, other exemplary embodiments of extendable nozzle 202 have a lid 360 that is selectively positioned over additive opening 350 to restrict access to additive cavity 318. In some such embodiments, additive opening 350 is defined at a top portion of nozzle body 310 (e.g., along the vertical direction V'). Thus, lid 360 may be selectively mounted on nozzle body 310 at the top portion thereof. As shown, lid 360 may be selectively fixed to nozzle body 310 (e.g., at a threaded collar 368 on nozzle body 310). In particular, lid 360 may be moved (e.g., rotated) between an open or unsealed position and a covered or sealed position (illustrated at FIG. 16). Generally, the unsealed position provides lid 360 apart from nozzle body 310 and reveals or uncovers additive opening 350, permitting access thereto. In the unsealed position, wash additive may thus be placed or flowed into additive cavity 318 through additive opening 350. By contrast, the sealed position provides lid 360 in engagement (e.g., direct or indirect contact) with nozzle body 310 (e.g., at threaded collar 368) directly above additive opening 350. Thus, in the sealed position, additive opening 350 is covered and wash additive is prevented from flowing through additive opening 350.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a tub positioned within the cabinet;

a wash basket rotatably mounted within the tub, the wash basket defining a wash chamber for receiving articles for washing; and a nozzle assembly mounted within the cabinet and configured to provide wash fluid to the tub, the nozzle assembly comprising an extendable nozzle movable between a retracted position and an extended position, the extendable nozzle defining a fluid path extending in fluid communication between a nozzle inlet and a nozzle outlet, the extendable nozzle further defining an additive cavity in fluid communication with the fluid path downstream from the nozzle inlet and an additive opening in selective fluid communication with the additive cavity in fluid parallel to the nozzle inlet, a valve assembly configured to provide a flow of wash fluid to the extendable nozzle, and a retractable fluid supply conduit extending in fluid communication between the valve assembly and the nozzle inlet of the extendable nozzle to direct the flow of wash fluid to the extendable nozzle.

2. The washing machine appliance of claim 1, wherein the additive cavity is spaced apart from the fluid path along a vertical direction, wherein the nozzle assembly further comprises a feed line extending in fluid communication from the additive cavity to the fluid path downstream from the nozzle inlet.

3. The washing machine appliance of claim 2, wherein the fluid path comprises a Venturi nozzle receiving the feed line between the nozzle inlet and the nozzle outlet.

4. The washing machine appliance of claim 1, wherein the nozzle assembly further comprises a user-depressible input in operative communication with the additive cavity to selectively direct wash additive from the additive cavity to the fluid path.

5. The washing machine appliance of claim 1, wherein the nozzle assembly further comprises an elastic check valve positioned in selective fluid communication between the additive cavity and the fluid path.

6. The washing machine appliance of claim 5, wherein the nozzle assembly further comprises a user-depressible input in pressurizing operative communication with the additive cavity to selectively motivate the elastic check valve to an open position in permitting fluid between the additive cavity and the fluid path.

7. The washing machine appliance of claim 1, wherein the additive cavity comprises a cavity entrance and a cavity exit positioned in fluid series along the fluid path.

8. The washing machine appliance of claim 7, wherein the cavity entrance or cavity exit receives a sharpened conduit prong defining a portion of the fluid path between the nozzle inlet and the nozzle outlet.

9. The washing machine appliance of claim 1, wherein the extendable nozzle comprises a nozzle body and a slidable tray selectively received within the nozzle body, wherein the additive cavity is at least partially defined by the slidable tray within the nozzle body.

10. The washing machine appliance of claim 1, wherein the nozzle assembly further comprises a biased door selectively covering the additive opening.

11. The washing machine appliance of claim 1, wherein the extendable nozzle comprises a nozzle body and a lid rotatably attached thereto, wherein the lid is selectively positioned over the additive opening to restrict access to the additive cavity.

12. A nozzle assembly for a washing machine appliance having a tub positioned within a cabinet, the nozzle assembly being mounted within the cabinet and configured to provide wash fluid to the tub, the nozzle assembly comprising:

an extendable nozzle movable between a retracted position and an extended position, the extendable nozzle defining a fluid path extending in fluid communication between a nozzle inlet and a nozzle outlet, the extendable nozzle further defining an additive cavity in fluid communication with the fluid path downstream from the nozzle inlet and an additive opening in selective fluid communication with the additive cavity in fluid parallel to the nozzle inlet;

a valve assembly configured to provide a flow of wash fluid to the extendable nozzle; and a retractable fluid supply conduit extending in fluid communication between the valve assembly and the nozzle inlet of the extendable nozzle to direct the flow of wash fluid to the extendable nozzle.

13. The nozzle assembly of claim 12, wherein the additive cavity is spaced apart from the fluid path along a vertical direction, wherein the nozzle assembly further comprises a feed line extending in fluid communication from the additive cavity to the fluid path downstream from the nozzle inlet, and wherein the fluid path comprises a Venturi nozzle receiving the feed line between the nozzle inlet and the nozzle outlet.

14. The nozzle assembly of claim 12, wherein the nozzle assembly further comprises a user-depressible input in operative communication with the additive cavity to selectively direct additive from the additive cavity to the fluid path.

15. The nozzle assembly of claim 12, wherein the nozzle assembly further comprises an elastic check valve positioned in selective fluid communication between the additive cavity and the fluid path.

16. The nozzle assembly of claim 12, wherein the additive cavity comprises a cavity entrance and a cavity exit positioned in fluid series along the fluid path.

17. The nozzle assembly of claim 16, wherein the cavity entrance or cavity exit receives a sharpened conduit prong defining a portion of the fluid path between the nozzle inlet and the nozzle outlet.

18. The nozzle assembly of claim 12, wherein the extendable nozzle comprises a nozzle body and a slidable tray selectively received within the nozzle body, wherein the additive cavity is at least partially defined by the slidable tray within the nozzle body.

19. The nozzle assembly of claim 12, wherein the nozzle assembly further comprises a biased door selectively covering the additive opening.

20. The nozzle assembly of claim 12, wherein the extendable nozzle comprises a nozzle body and a lid rotatably attached thereto, wherein the lid is selectively positioned over the additive opening to restrict access to the additive cavity.

* * * * *